US005520341A

United States Patent [19]

Boenisch

[11] Patent Number: 5,520,341

[45] Date of Patent: May 28, 1996

[54] APPARATUS FOR REGENERATING FOUNDRY SAND

[76] Inventor: Dietmar Boenisch, Emmi-Welter-Str. 8, W-5100 Aachen, Germany

[21] Appl. No.: 407,161

[22] Filed: Mar. 21, 1995

Related U.S. Application Data

[62] Division of Ser. No. 46,007, Apr. 9, 1993, Pat. No. 5,439,044.

[30] Foreign Application Priority Data

Apr. 10, 1992 [DE] Germany ..... 42 12 097.7

[51] Int. Cl.[6] ..... B02C 19/06; B02C 23/20

[52] U.S. Cl. ..... 241/41; 241/57; 241/79.1; 241/275; 241/DIG. 10

[58] Field of Search ..... 241/38, 39, 41, 241/52, 57, 60, 61, 62, 79.1, 275, DIG. 10

[56] References Cited

U.S. PATENT DOCUMENTS

| | | | |
|---|---|---|---|
| 335,574 | 2/1886 | Fuller et al. | 241/57 |
| 2,309,036 | 1/1943 | Beardsley | 241/58 X |
| 3,913,847 | 10/1975 | Glatt et al. | 241/57 |
| 4,436,138 | 3/1984 | Kondo | 241/DIG. 10 X |
| 5,045,090 | 9/1991 | Pohl | 241/57 X |
| 5,289,920 | 3/1994 | Godderidge et al. | 241/DIG. 10 X |
| 5,330,112 | 7/1994 | Nagaoka et al. | 241/57 |
| 5,381,968 | 1/1995 | Lohnherr et al. | 241/52 X |

FOREIGN PATENT DOCUMENTS

| | | | |
|---|---|---|---|
| 471929 | 9/1937 | United Kingdom | 241/52 |

*Primary Examiner*—Timothy V. Eley
*Attorney, Agent, or Firm*—Herbert Dubno

[57] ABSTRACT

A foundry sand is regenerated in an upright chamber to which air is admitted at the junction between a peripheral wall and between while an abrading rotor is in a horizontal plane close to the bottom to establish a vertical line with columns of fluidized sand outwardly of the orbit of the rotor.

10 Claims, 3 Drawing Sheets

APPARATUS FOR REGENERATING FOUNDRY SAND

This is a divisional of application Ser. No. 08/046,007 filed on 9 Apr. 1993, now U.S. Pat. No. 5,439,044.

FIELD OF THE INVENTION

The present invention relates to a method of and an apparatus for regenerating foundry sand, i.e. sand used in the preparation of sand casting molds for metallurgical purposes and the production of metal workpieces. More particularly, the invention relates to the regeneration of foundry sands of this type utilizing an abrasion process. The invention also relates to the treatment of new sand for incorporation into a foundry sand.

BACKGROUND OF THE INVENTION

Rising costs and legal requirements with respect to the disposal of foundry sand in land fills and the like have increased and the need for regeneration and reuse of foundry sands. A variety of regenerating processes are known and regeneration apparatus is commercially available and currently in use.

The regeneration of bentonite-containing mixed sands has posed particular problems because of the very large quantity of contaminants which tend to be present in the depleted foundry sand. At the present time, thermo-mechanical regeneration is favored as is described, for example, in EP 0 343 272 A1 and which can be compared with other known purposes. In this thermo-mechanical process, the sand is initially annealed in a thermal treatment stage at temperatures from 500° to 900° C. and, after an appropriate cooling, is fed batchwise into a friction or grinding machine in which the dead-burned binder residue which has not been volatized by the annealing process is abraded from the grains of sand by rotating transverse arms. Compressed air blown through the sand filling in the machine from time to time carries away the dust which is liberated by the abrasion process.

Thermal regeneration treatments, however, have not been fully acceptable heretofore because of the cost and time required.

The high capital cost, operating and maintenance costs of earlier apparatus for the regeneration of foundry sand have made many of the earlier systems unsuitable or unacceptable for small and medium-size foundries and have resulted in the need to transport foundry sand from the foundry or to return the foundry sand after treatment to the foundry with expensive transport processes.

Old sand may have heat values in the form of carbon containing components and some bentonite as valuable constituents which are dead burned and lost. Sand grains can fracture as a result of the temperature variations and can be transformed to waste. The amount of waste may thereby be increased beyond that which is desirable or acceptable and the grain spectrum or particle size distribution in the foundry sand may be varied in an impermissible manner. Environmental problems arise from the production of heat and carbon dioxide by the foundry in the regeneration of foundry sand. Restrictions in the amounts of heat and $CO_2$ which can be liberated by a particular foundry can limit foundry furnace operations in other respects.

In more recent publications, therefore, regeneration processes have been described in which the dead burning of the entire bulk of the old sand can be avoided (see DE 41 06 736 A1, DE 41 06 737 A1, DE 41 21 765 A1 and EP 0 465 778 A2).

When, however, the thermal regeneration step is eliminated, the requirements for a mechanical regenerating machine are significantly higher than with earlier machines since the mechanical operation must satisfy the full need for cleaning the sand grains.

Investigation into commercially available machines has shown that these machines have a variety of drawbacks and disadvantages which limit the quality of regeneration or only allow satisfactory regeneration after long processing times.

Impingement-type cleaning operations in which the sand grains are entrained in high velocity air jets and the stream is directed against impingement baffles, consume relatively too much compressed air and generate large amounts of residues because of the rupture of the sand grains.

Rotary drums with plural drives and strippers are expensive when they must be designed to accommodate hot depleted foundry sand and to tolerate the high degree of wear and the tendency to breakdown which thus results.

With grinding machines which have commonly been used after a thermal treatment stage, the removal of dust is generally effected either by transverse air which can entrain the dust only over the batch in the vessel, or by means of compressed air. When compressed air, however, is fed to the grinding machine of EP 0 343 72 A1 by a multiplicity of nozzles at the upper machine bottom, there is formed in the region of the transverse arms, a fluidized bed which transfers with requisite friction effect. With sand which contains active clay, there is insufficient abrasion which influences the suitability of the regenerated product for the production of foundry cores.

To overcome this problem, machine operating times are increased or the amounts of materials passed through the machine are reduced.

Furthermore, the abrasion does not always affect the entire charge in the machine and it is found that at the bottom and side wall corners of the machine there are dead zones where untreated sand can accumulate, the untreated sand serving to contaminate the regenerated product.

OBJECTS OF THE INVENTION

It is therefore an object of the present invention to provide a simple process for regenerating foundry sand and especially depleted or old sand which still contains active bentonite, utilizing an apparatus which can be operated at low cost and while avoiding the need for annealing or otherwise thermally treating the sand.

Another object of the invention is to provide a method of and an apparatus for the regeneration of a foundry sand which involves low capital cost, low operating cost and low maintenance cost and is particularly suitable for small foundries.

It is also an object of the invention, therefore, to provide an apparatus which occupies a relatively small area, which is flexible in the sense that it can be used for a wide variety of sand cleaning purposes and under a wide variety of conditions and which can be used in a simple and uncomplicated way for most required sand preparations.

It is also an important object of the invention to provide a process for the purposes described which avoids fragmenting the sand grains by impingement action and which nevertheless insures a high degree of grain-to-grain friction so that even hard contaminants baked upon the sand grains can be rubbed off and the grains themselves ground and advantageously rounded.

According to another object of the invention, the grain-to-grain friction in a regenerating charge should be clearly increased over prior systems so that contaminants can be removed as completely as possible and the duration of treatment of a particular charge can be reduced.

SUMMARY OF THE INVENTION

These objects and others which will become apparent hereinafter are attained, in accordance with the invention, in a process in which a horizontally rotating grinding or abrading tool is provided in an upright grinding machine for the regeneration of foundry sand and a compressed air source is provided.

According to the invention, the air is admitted only outside of the orbit of the vanes of the tool through the bottom and/or the side wall in the outer region of the sand filling and, in cooperation with the rotating vanes, an upward fluidized column of the sand is generated in the peripheral region of the chamber inducing the sand to move upwardly. The dust-laden sand is removed above the filling in the chamber and then no longer fluidized dense sand passes downwardly in a central stream.

More particularly, the method of the invention comprises the steps of:

(a) circulating depleted foundry sand in an upright dry abrading chamber by causing the foundry sand to descend onto a horizontal rotating abrading tool, displacing the foundry sand outwardly with the tool and inducing the foundry sand to rise in the chamber outwardly of an orbit of the tool to a level of foundry sand in the chamber;

(b) admitting air to the chamber at a bottom of the chamber and outwardly of the orbit to fluidize a rising column of the foundry sand outwardly of the orbit;

(c) removing a dust-laden air above the level of the foundry sand in the chamber; and (d) enabling nonfluidized foundry sand at the level to pass inwardly to a downward central stream of the foundry sand descending to the horizontal abrading tool.

In apparatus terms, the invention comprises:

means forming an upright chamber having a peripheral wall and a bottom;

at least one horizontally rotating abrading tool in the chamber located close to the bottom for circulating depleted foundry sand by causing the foundry sand to descend onto the tool, displacing the foundry sand outwardly and inducing the foundry sand to rise in the chamber outwardly of an orbit of the tool to a level of foundry sand in the chamber;

means for removing a dust-laden air above the level of the foundry sand in the chamber; and means for admitting air to the chamber outside the orbit, cost to the bottom and at the wall for fluidizing a rising column of the foundry air in the chamber outwardly of the orbit whereby nonfluidized foundry sand at the level passes inwardly from the column to a central downward stream of the foundry sand descending to the horizontal abrading tool.

The admission of air can be effected with the injection of air as compressed air or by drawing air under suction into the chamber.

According to a feature of the invention, the air is admitted to the chamber through a plurality of locations horizontally and spaced apart from one another at locations proximal to the bottom and to the peripheral wall of the chamber. The upwardly moving fluidized column and the downwardly moving stream can be separated by a partition in the chamber which is open upwardly and downwardly.

According to a feature of the invention, the speed of the abrading tool and/or the pressure, volume, inlet locations and inlet directions for the air can be varied during the course of regenerization and can be matched to the progress of cleaning of the sand grains and removal of dust.

The progress of cleaning can be monitored by monitoring the current or power draw of the motor driving the tool.

The monitoring output signal can be used to control other operating parameters in the processing of the batch, for example, the feed of the material to the apparatus, the air flow, etc.

Air can be admitted, in addition, at other levels of the wall, either by being blown in or being sucked to the chamber. The dust laden discharged air can be led through a funnel-shaped sand catcher to the discharge duct. The discharge of the dust laden air can be effected by applying suction to the duct and/or the blowing of transverse air into the chamber below the sand catcher. The transverse air may also be used in the absence of suction to displace the dust laden air from the chamber and to control the outflow of the dust laden air.

The unburned valuable materials, such as heat values and active bentonite in which the waste air is clearly enriched at least initially in the treatment of the sand can be collected separately for reuse.

During a precleaning phase of the process, the abrading rotor need not be driven at all or can be driven only slowly.

Advantageously, the abrading rotor can have at least two arcuate vanes and can be driven by a speed-regulatable motor.

The admission of the air into the chamber can be effected at a corner region between the bottom and the wall, preferably from at least two groups of segment shaped individual chambers. The wall itself can be surrounded by one or more air chambers having feed lines for the air which can be controllable independently from one another. The inlets can be self cleaning annular gaps, shaped apart ring segments or air slits and, where air is admitted into the chamber, it can be admitted through sand-tight inserts of porous sintered metal or sand filters.

According to a further aspect of the invention the apparatus is utilized to round new or fresh sand by a pregrinding operation.

Since the air is only caused to pass upwardly through the periphery of the sand filling in the container, to fluidify the sand in the annular peripheral region externally of the orbit of the abrading rotor, the fluidization only is effected along the peripheral wall. The compressed air, therefore, tends to form bubbles in this column which entrain the dust abraded from the sand grains, while lifting the sand grains themselves, and thoroughly clean the surfaces of the sand grains and entrain that dust out of the filling. The sand itself passes inwardly to the descending stream and returns to the abrading tool. The sand particles which may have been carried by the air out of the filling are collected in the funnel, as a result of the decrease in velocity above the constricted aperture of the funnel and can cascade back onto the surface of the filling to pass downwardly in the stream to the abrading rotor. As a consequence, the apparatus has a vertical circulation effect. The binder residues adherent to the sand grains are not only abraded therefrom by the abrading rotor or grinding rotor, but are also released by the grain-to-grain friction within the moving mass of sand. This type of frictional removal of the residues can be increased by injecting sharp compressed air jets into the peripheral region of the filling and is especially effective when electrostatically adherent plastic or synthetic resin particles must be released.

Since an excessively high degree of fluidization in the region neighboring the wall can significantly decrease the effectiveness of the rotor, it is important to maintain the rising fluidized column wholly externally of the orbit of the rotor.

This can be insured by admitting the compressed air from spaced apart inlets at the junction between the bottom and the peripheral wall. In this case, column like zones of fluidized sand are formed directly adjacent these inlet locations and extend vertically, being separated from one another by columns of dense sand.

As a consequence, the formation of a coherent tubular fluidized bed along the machine wall can be avoided. Because intervening columns of more dense sand or sand with a greater degree of packing can form between discrete vertical columns at each inlet, the grinding machine need not have additional baffles in the cylindrical chamber to break up a fluidized bed or column which may propogate inwardly and may influence the effect of the rotor. It is important, as will be apparent from what has been stated previously, that the central stream of more dense descending sand be permitted to be set into rotation by the rotor like a core in a bearing.

The vertical circulation effect can be reinforced when the upwardly and downwardly moving streams are separated by an upwardly and downwardly open annular partition.

The partition can open at its upper end above the filling or the "level" mentioned previously and terminate at its lower end just above the abrading rotor.

The number and size of the bubbles which are formed in the sand can be varied by controlling the air introduced not only at the lowest point in the chamber but partly also through the peripheral wall above the rotor.

The lateral inlets at upper levels may be angularly offset from one another.

During the course of the regeneration treatment, the composition changes as do various characteristics or parameters such as the flow properties or rheology of the sand so that alterations of various operating parameters is desirable. At the commencement of the treatment there is a temperature equalization in the sand filling which is especially apparent between newly added sand and sand which may have been retained in the chamber and is most noticeable with depleted sand which has not been thoroughly mixed.

Initially as well, active bentonite which may be adherent to the sand grains is, dried, rubbed off, and, together with carbon particles, is carried away in the removed air which is enriched in these materials. These valuable components can be separately collected, e.g. from a gas cleaning cyclone or other gas cleaning installation for reuse in the preparation of foundry sand.

The change in the flow conditions of the sand filling also changes the current draw of the drive motor and can be monitored to indicate the degree of regeneration or the progress thereof. The current draw can be converted into a signal for varying the cross section of a compressed air line and thus the supply of compressed air and/or for controlling the speed of the rotor so that the abrading intensity can be varied to the desired degree.

The control process can be automatic. With the aid of such a signal, moreover, the completion of regeneration can be signalled for a specific charge.

Indeed, the machine operating or residence time for a particular regenerated product depends upon the composition of the depleted sand and can be monitored through the drive motor as described as the composition changes with mold sand circulation.

Many depleted sands contain relatively large amounts of dust, namely, carbon dust and bentonite. It is advantageous to collect these materials at the beginning of the abrading process and for that purpose I may provide a precleaning phase in which the abrading rotor is at a standstill or is rotated so slowly that the sand filling is mixed without significant abrasion.

The discharge of dust can be effected or controlled by injecting into the chamber above the sand filling, radially or tangentially, transverse air from which the fine grain sand can be deposited at the latest in the funnel-shaped collector by cyclonic action. This separated sand returns to the sand circulation to maintain the grain size spectrum.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
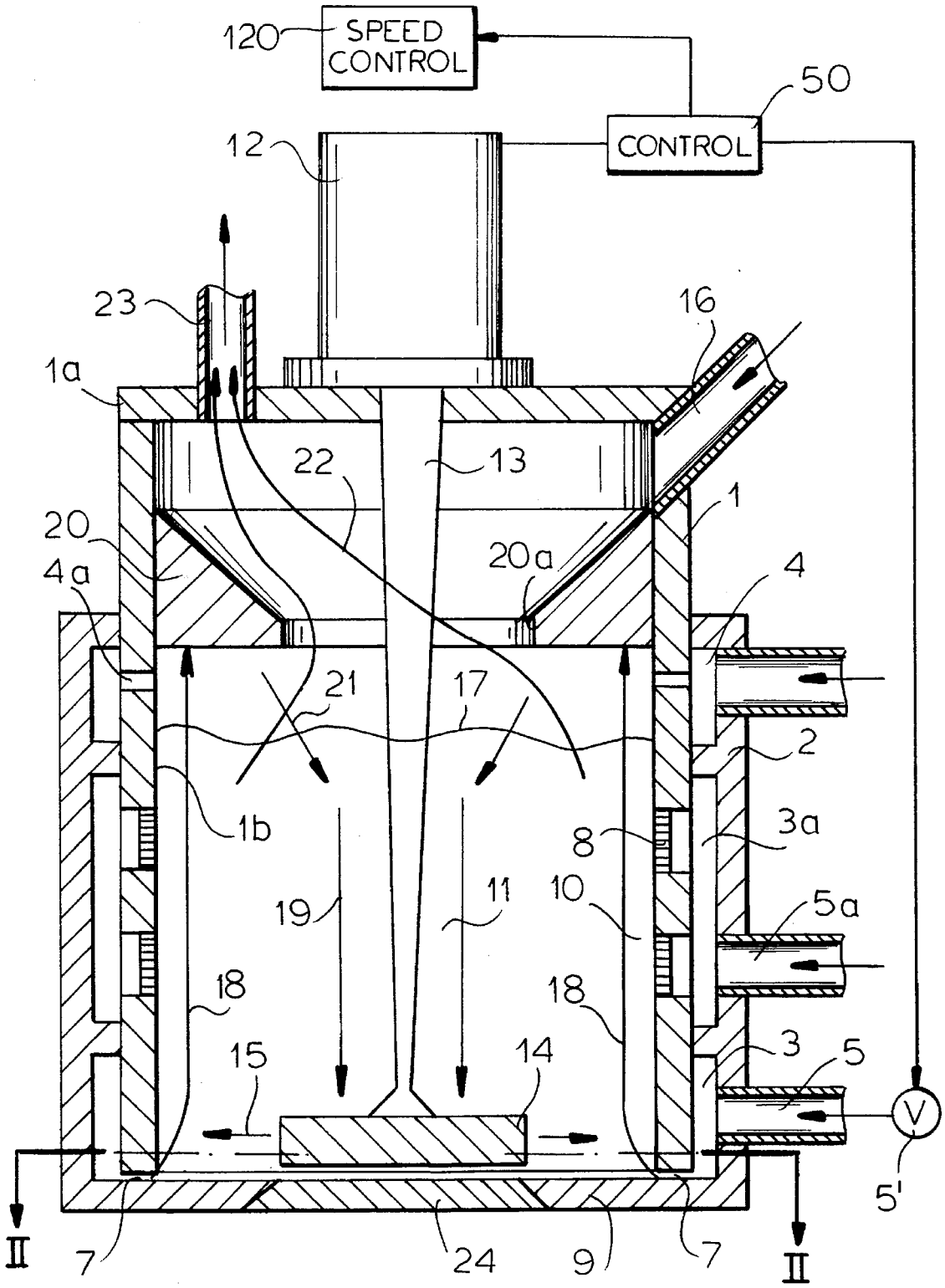
FIG. 1 is a vertical section in highly diagrammatic form showing a cylindrical foundry sand grinding and regenerating machine.
Figure 2:
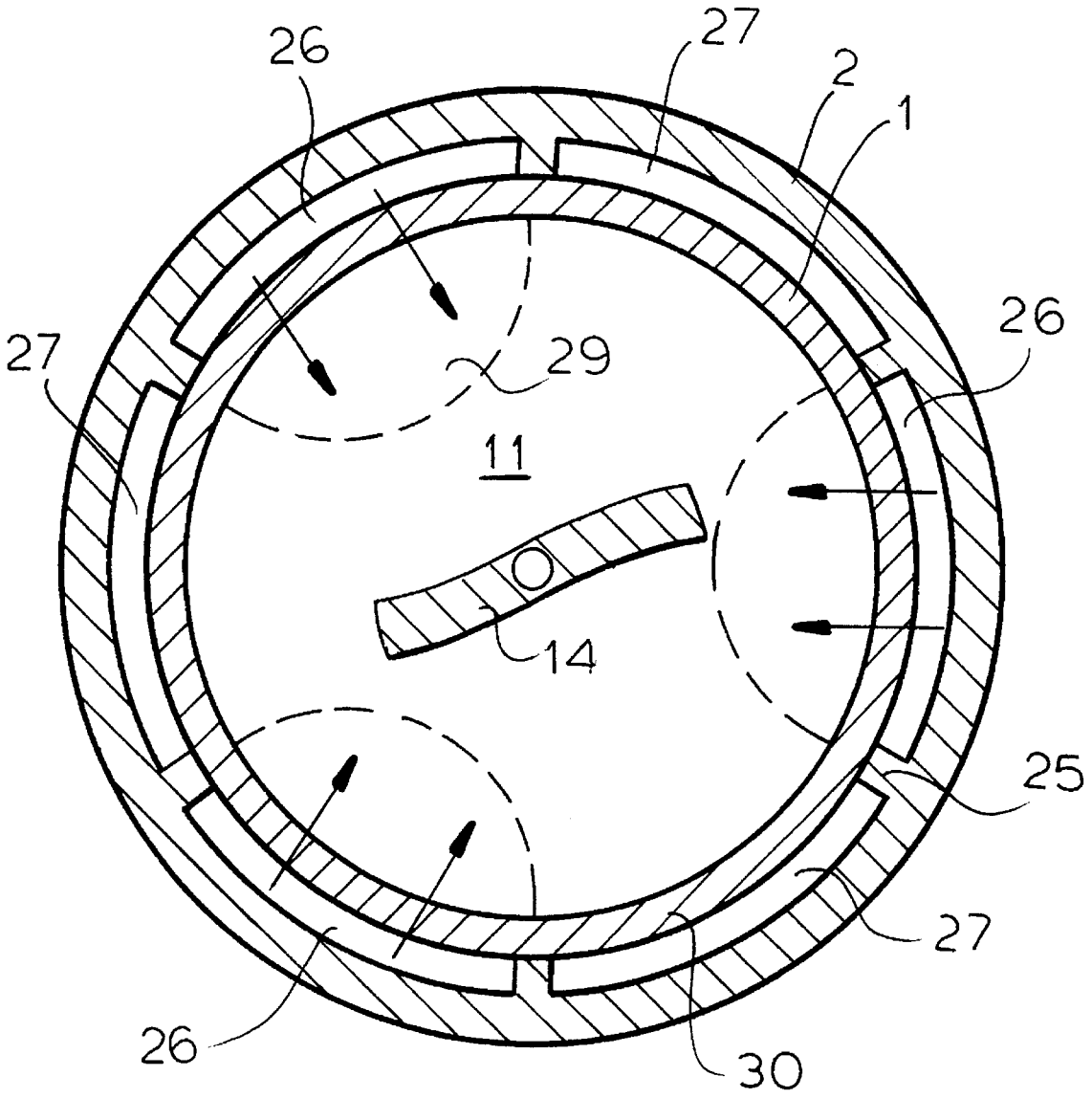
FIG. 2 is a section taken along the line II—II of FIG. 1.

The machine shown in FIGS. 1 and 2 has a cylindrical container 1 provided with a cover 1*a* shaped on which a drive motor 12 is mounted. The cylindrical container 1 also has a bottom 9 and a peripheral wall 1*b*.

The lower portion of the container 1 has a jacket 22 which is formed with the bottom 9 and defines with the peripheral wall 1*b*, air chambers 3, 3*a* and 4 which have separate inlet lines or ducts 5, 5*a* and 6 for compressed air with respective valves, only one of which has been represented at 5' in FIG. 1.

The motor 12 is provided with a circuit 50 which monitors the current drawn by the motor 12 and can feed a signal, for example, to the valve 5' or to a speed controller 120 of the motor to regulate an operating parameter of the machine as described.

Fluidizing and dust removing air is admitted to the interior of the housing 1 through an annular gap 7 between the peripheral wall 1*b* and the bottom 9 and through air inlet slits or nozzles 8 at higher locations along the peripheral wall through the respective chambers 3, 3*a* and 4. The inlets 4*a* from the chamber 4 are directed transversely across the top of the filling below the sand catcher 20 to form the transverse jets which have been described. The inlets 8 can be provided with sintered metal sand filters preventing passage of sand through those inlets in the chamber 3*a*.

The cover 1*a* shaped is provided with an outlet duct 23 through which discharged air with entrained dust can be removed and valuable constituents can be recovered from this air, e.g. in a cyclone downstream of the apparatus and not shown. As is apparent, the motor 12, which is centrally mounted on the cover 1*a*, is a speed-controllable motor which has a slightly downwardly tapered shaft 13 at the free end of which a horizontal abrading or grinding rotor 14 is mounted slightly above a bottom plate 24 of the bottom. The bottom plate 24 is removable from the bottom to allow the regenerated sand to be removed.

The rotor 14 can also be arranged on an eccentric and can be driven from below, as desired, requiring only the shifting of the discharge opening.

As can be seen from FIG. 2, the rotor 14 can have two slightly curved blades.

The sand is introduced into the chamber through a closable filling fitting 16 which is provided above the inclined surface of the funnel shaped sand collector 20 and introduces sand into the chamber to the level 17.

FIG. 2 shows that the air chamber adjacent the bottom 9 is subdivided by partition 25 into two groups of segment-like individual chambers 26, 27. Such a subdivision also can be effected for the air chamber 3*a* shown in FIG. 1 above the chamber 3.

The individual segmental air chambers are alternatingly supplied with compressed air so that respective rising columns of fluidized sand will be formed as indicated in the effective regions 29 in the direction of injection of the air through the respective slits 7.

In the outer region 10 beyond the orbit of the rotor 14, therefore, there are zones 30 which are little affected by the air and thus have a relatively dense packing of the sand and form braking and support bodies of the sand which oppose the rotation of the sand by the rotor 14. As a result, the rising columns as represented by arrows 28 frictionally interact with the relatively stationary columns between them and, moreover, the penetration of the fluidized beds inwardly beyond the orbit of the rotor is minimized or excluded. The action of the rotor, thereby remains effective.

In operation, the rising columns represented by the zones of 28 of fluidized sand whose dust is entrained with the air, pass to the top or level 17, where the dense sand moves inwardly and the air is accelerated through the narrower orifice 20*a* of the funnel.

The dust-entraining air is discharged at 23 and the heavier particles separate out in the funnel and pass again into the sand filling below the funnel. The path of the dust entraining air is represented by the arrow 22.

Along the center of the sand filling in the region 11, there is a descending stream of sand represented by the arrows 19, the sand contacting the rotor 14 and being subjected to abrasion thereby as the sand is then centrifugally directed outwardly (arrows 15) to be entrained anew upwardly in the rising columns.

To prevent untreated sand and dust or residues from collecting at the corners of the zones in which air is not introduced through the slit 7, the chambers 26 and 27 alternate in function, one receiving air while the other is inactive and vice versa.

Upon alternation of the compressed air flow in the chambers 26 and 27 dead zones are practically eliminated.

Figure 3:
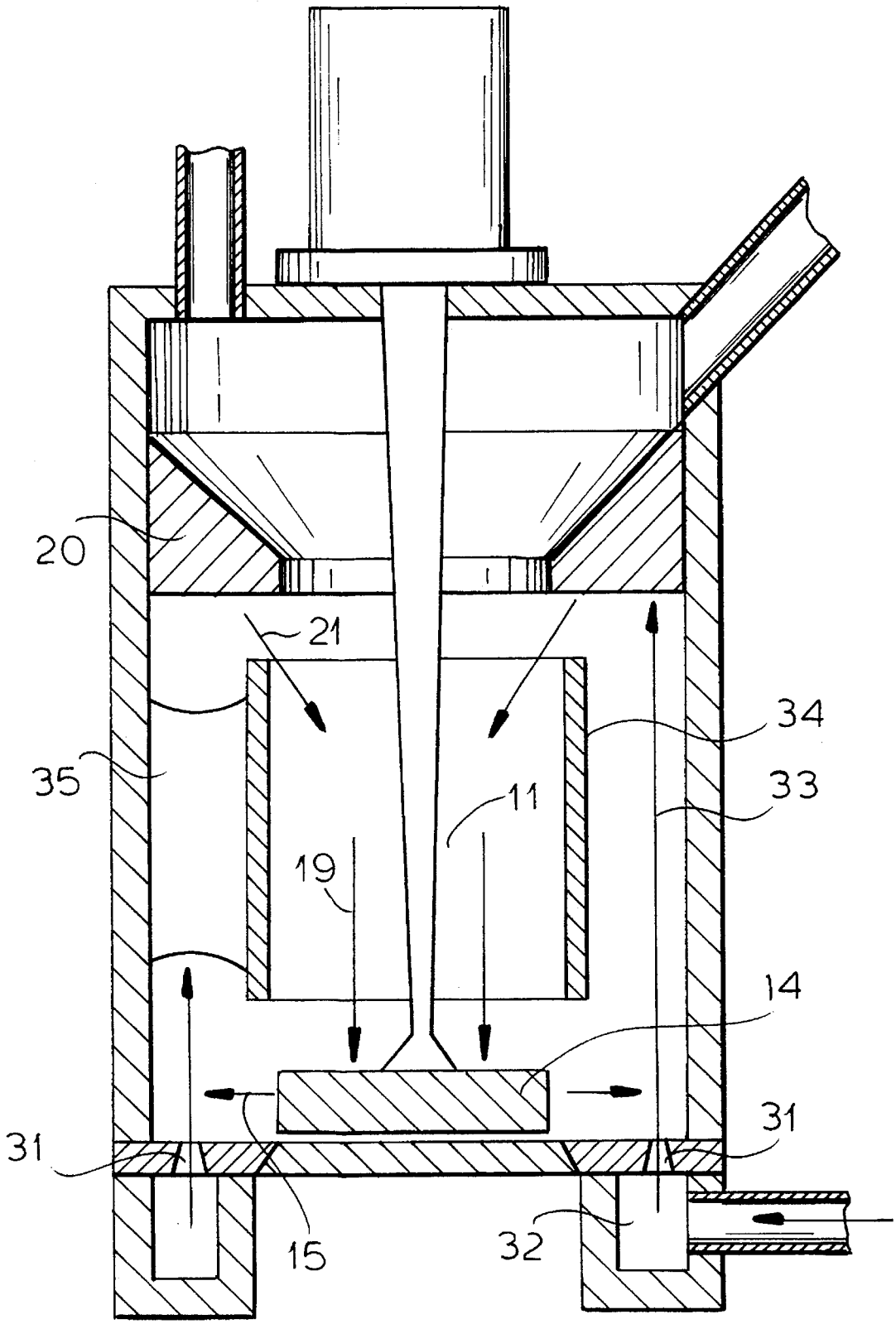
FIG. 3 is a section similar to FIG. 1 through a machine in accordance with another embodiment of the invention.

FIG. 3 shows another embodiment in which the bottom is formed with an annular nozzle-forming gap 31 converging in the direction of the chamber or with a plurality of individual nozzles.

The descending stream is separated from the ascending column by an annular partition 34 mounted with ribs 35 on the peripheral wall of the chamber.

In this embodiment, compressed air from the annular chamber 32 is injected in sharply defined jets 33 into the sand to effect an additional friction action in the outer region of the sand filling. The high velocity jets promote complete removal of residues from the sand which is abraded by the rotor 14 in the manner described and maintains the vertical vent of the sand as described.

In this embodiment as well, valuable components can be recovered from the entraining air.

In an early stage, before abrasive action is commenced by the rotor, the rotor can be rotated slowly while the air jets remove most of the valuable dust like materials in the precleaning operation. The circulation is represented in this embodiment by the arrows 15, 33, 21, 19. The mixing of the upwardly and downwardly moving streams of sand is prevented or limited by the partition 34 and undesired rotation thereof is prevented by the ribs 35.

I claim:

1. An apparatus for regenerating foundry sand, comprising:

means forming an upright chamber having an axis and formed with an annular peripheral wall and a bottom;

at least one abrading horizontal tool mounted in said chamber at a short distance from said bottom and rotatable about said axis;

means for feeding foundry sand downwardly in a generally vertical central stream in said chamber to said bottom, said tool displacing the sand toward said peripheral wall to form an annular column of said foundry sand rising exclusively of an orbit of said tool;

supply means at spaced locations in said peripheral wall and close to said bottom for supplying air along generally upward paths and exclusively outwardly of said orbit, said column being raised in said chamber upon displacing of said sand by said tool and upon by the air supplied to a level in an upper part of said chamber and having a plurality of zones of less dense fluidized sand along said paths at said spaced locations and zones with more dense sand between said locations, said foundry sand in said zones of less dense sand upon reaching said level being displaced radially inwardly toward said axis to redescend along said central stream downwardly to said abrading tool; and means for removing a dust-laden air above said level of said foundry sand in said chamber.

2. The apparatus defined in claim 1 wherein said abrading tool has two arcuate vanes and is driven by a speed-regulatable motor.

3. The apparatus defined in claim 2 wherein said means for admitting said air includes inlets for air at a corner region between said bottom and said wall.

4. The apparatus defined in claim 3 wherein said inlets are comprised of at least two groups of segment shaped individual chambers.

5. The apparatus defined in claim 4 wherein said wall of said upright chamber is surrounded by a jacket spaced radially from said wall and forming therewith at least one chamber provided with a respective air line, said air line being individually controllable.

6. The apparatus defined in claim 1 wherein the means for admitting air includes at least one annular gap or annular gap segment or slit.

7. The apparatus defined in claim 1 wherein said means for admitting air includes at least one inlet formed with a sand filter preventing outflow of sand therethrough.

8. The apparatus defined in claim 1, further comprising an annular partition open upwardly and downwardly in said chamber separating said column from said downwardly central stream.

9. The apparatus defined in claim 1, further comprising means for feeding depleted foundry sand to said chamber along a delivery path and between said level and said means for said depleted foundry sand to said chamber, a funnel-shaped sand catcher.

10. The apparatus defined in claim 9, further comprising between an underside of said catcher and said level inlet nozzle for admitting transverse to said sand path air jets into said chamber.

* * * * *